US007134727B2

(12) United States Patent
Williams

(10) Patent No.: US 7,134,727 B2
(45) Date of Patent: Nov. 14, 2006

(54) SOFA LOVERS' SOFA

(76) Inventor: Kevin Williams, 3718 Seminary Rd., Alexandria, VA (US) 22304

( * ) Notice: Subject to any disclaimer, the term of this patent is extended or adjusted under 35 U.S.C. 154(b) by 0 days.

(21) Appl. No.: 10/942,910

(22) Filed: Sep. 17, 2004

(65) Prior Publication Data

US 2005/0121949 A1 Jun. 9, 2005

Related U.S. Application Data

(63) Continuation-in-part of application No. 09/758,660, filed on Jan. 12, 2001, now Pat. No. 6,811,214.

(51) Int. Cl.
*A47C 7/54* (2006.01)

(52) U.S. Cl. ..... 297/411.32; 297/411.38; 297/411.3; 297/115

(58) Field of Classification Search ..... 297/115, 297/116, 117, 118, 411.23, 411.24, 411.3, 297/411.31, 411.35, 411.37, 353, 354.12, 297/411.32, 411.34, 411.38, 10, 11, 12, 80; 5/52, 53.2, 59.1, 6, 7, 93.2
See application file for complete search history.

(56) References Cited

U.S. PATENT DOCUMENTS 797,852 A * 8/1905 Hayden ..... 5/3
863,874 A * 8/1907 Rajner ..... 297/115
1,391,566 A * 9/1921 Musselman ..... 5/2.1
2,610,329 A * 9/1952 Strathaus ..... 5/59.1
2,642,585 A * 6/1953 Piliero ..... 5/59.1
2,660,734 A * 12/1953 Dumble et al. ..... 5/59.1
2,679,653 A * 6/1954 Blanke et al. ..... 5/12.1
2,866,496 A * 12/1958 Glass ..... 297/113
3,248,742 A * 5/1966 Johnson ..... 5/53.1
3,419,921 A * 1/1969 Flood ..... 5/308
3,910,630 A * 10/1975 Runyon et al. ..... 297/63
4,672,698 A * 6/1987 Sands ..... 5/424
4,811,436 A * 3/1989 Schwartz ..... 5/93.1
5,517,706 A * 5/1996 Kashima et al. ..... 5/12.1
5,575,535 A * 11/1996 Burchett et al. ..... 297/464
6,520,586 B1 * 2/2003 Park ..... 297/411.32
6,594,834 B1 * 7/2003 Fenty et al. ..... 5/93.2

FOREIGN PATENT DOCUMENTS

JP 360244633 A * 12/1985

* cited by examiner

*Primary Examiner*—Peter M. Cuomo
*Assistant Examiner*—Joseph Edell
(74) *Attorney, Agent, or Firm*—Nath & Associates PLLC; Gregory B. Kang; Derek Richmond

(57) ABSTRACT

In some embodiments of the sofa lover's sofa, a sofa or the like can have an end cushion comprising a lower stationary member approximating the height of an armrest of the sofa and a rotatable upper member that may be rotated to overlie an armrest of the sofa. Thus, a back support may be provided for sitting crosswise on the sofa. In other embodiments of the sofa lover's sofa, a sofa or the like can have a lower front panel that is rotatable to a position overlying a seat cushion so as to act as an armrest for a person sitting crosswise on the sofa.

7 Claims, 7 Drawing Sheets

SOFA LOVERS' SOFA

This application is a continuation-in-part of application Ser. No. 09/758,660 filed Jan. 12, 2001, now U.S. Pat. No. 6,811,214 issued on Nov. 2, 2004, the contents of which are incorporated herein by reference in their entirety.

FIELD OF THE INVENTION

The present invention relates to adjustable sofas and more particularly to a sofa in which members of a front-lower panel of the sofa may be raised to a height of each standard armrest of the sofa and/or a portion of the backrest of the sofa may be rotated so as to provide a backrest extending directly over the top of the standard armrest for a person lying across the sofa with the person's legs lying on the seat cushions of the sofa.

BACKGROUND OF THE INVENTION

People often lie across a sofa; that is, with their head resting on a standard armrest of the sofa and their bodies stretched lengthwise across the sofa, from armrest to armrest. Lying this way, at times, is for comfort and at other times, is for viewing TV or conversing with someone located generally seated near an opposite armrest of the sofa so that both people are seated likewise on the sofa facing each other.

Generally, when a person is seated in such a manner, he can use the back of the sofa as an armrest for one arm though it is not at a comfortable height for long term seating; and, there is no corresponding armrest for the other arm nor upper back support. The only option is to attempt to provide support for the otherwise unsupported arm using a firm cushion or other object that is unconnected to the couch such as a pillow, table or another article of furniture.

SUMMARY OF INVENTIVE ASPECTS

Embodiments of the Sofa Lover's Sofa permit a person to enjoy support for both arms while sitting lengthwise across a sofa with the person's back resting against the rotated backrest atop the traditional standard armrest of the sofa and the person's feet extended toward an opposite armrest of the sofa. For example, support for a person's unsupported arm (referred to herein as the "outward arm") is provided by rotating a front lower panel upward so that a resulting upper edge thereof is at a height generally equal to that of a standard armrest of the sofa. Equality of armrests is not necessary, as an embodiment of the present invention includes armrests that are adjustable in height.

Also, an upper portion of a rear backrest of a sofa can rotate to a position overlying the sofa armrest thereby providing backrest support and possibly a headrest for a person sitting lengthwise on the sofa. The remaining stationary (lower) portion of the traditional backrest (which remains after the upper portion has been rotated away) becomes an armrest for the person's arm now resting at the traditional rear/back of the sofa.

Further, a rotatable rod can be positioned within a front lower panel such that the front lower panel can rotate up, with the rotatable rod as an axis of rotation of the front lower panel, the panel, so raised then serves as an armrest for a person's outward arm. The front, lower panel can lock into place using a locking mechanism such as a ball-and socket. A torsion spring can be wrapped around the rod to bias the front lower panel to either a stowed position or in a raised position.

In accordance with a further embodiment of the present invention, a four-bar linkage can be attached to the front lower panel and to the sofa's frame such that the front lower panel can rotate up to serve as an armrest for a person's outward arm. The front lower panel can lock into place in this embodiment with a spring.

Yet another embodiment of the sofa lover's sofa is a bench sofa. A bench sofa is a sofa having no standard armrests. Front panel end portions can be used on the bench sofa to rotate upward and lock in place in any manner described above to serve as armrests.

The above and other features, objects, and advantages of embodiments of the present invention, together with the best means contemplated by the inventor thereof for carrying out the invention will become more apparent from reading the following description of embodiments and perusing the associated drawings.

DETAILED DESCRIPTION OF THE PRESENT INVENTION

Figure 1:
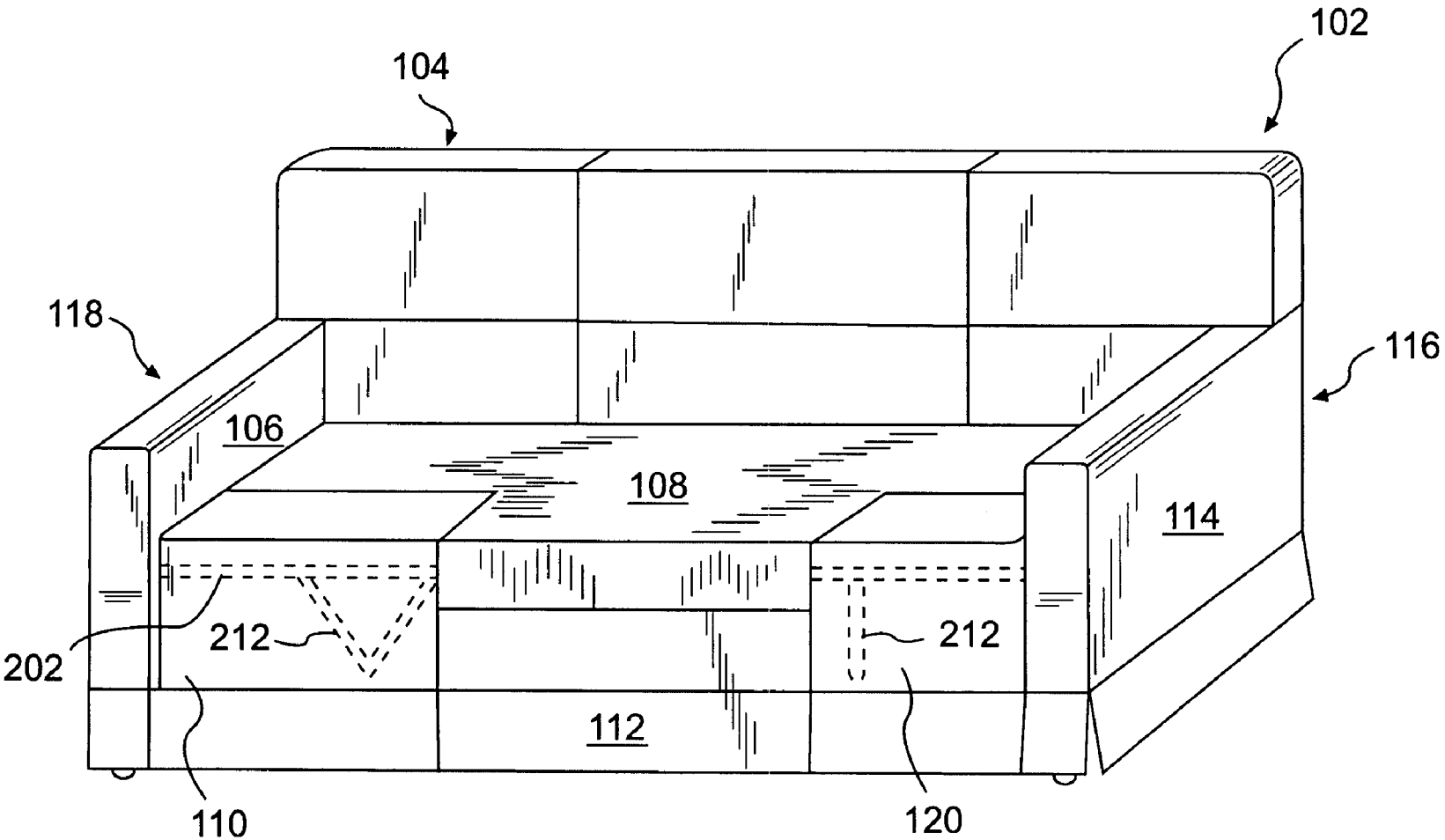
FIG. 1 shows a preferred embodiment of the sofa lover's sofa in a sofa configuration.
Figure 2:
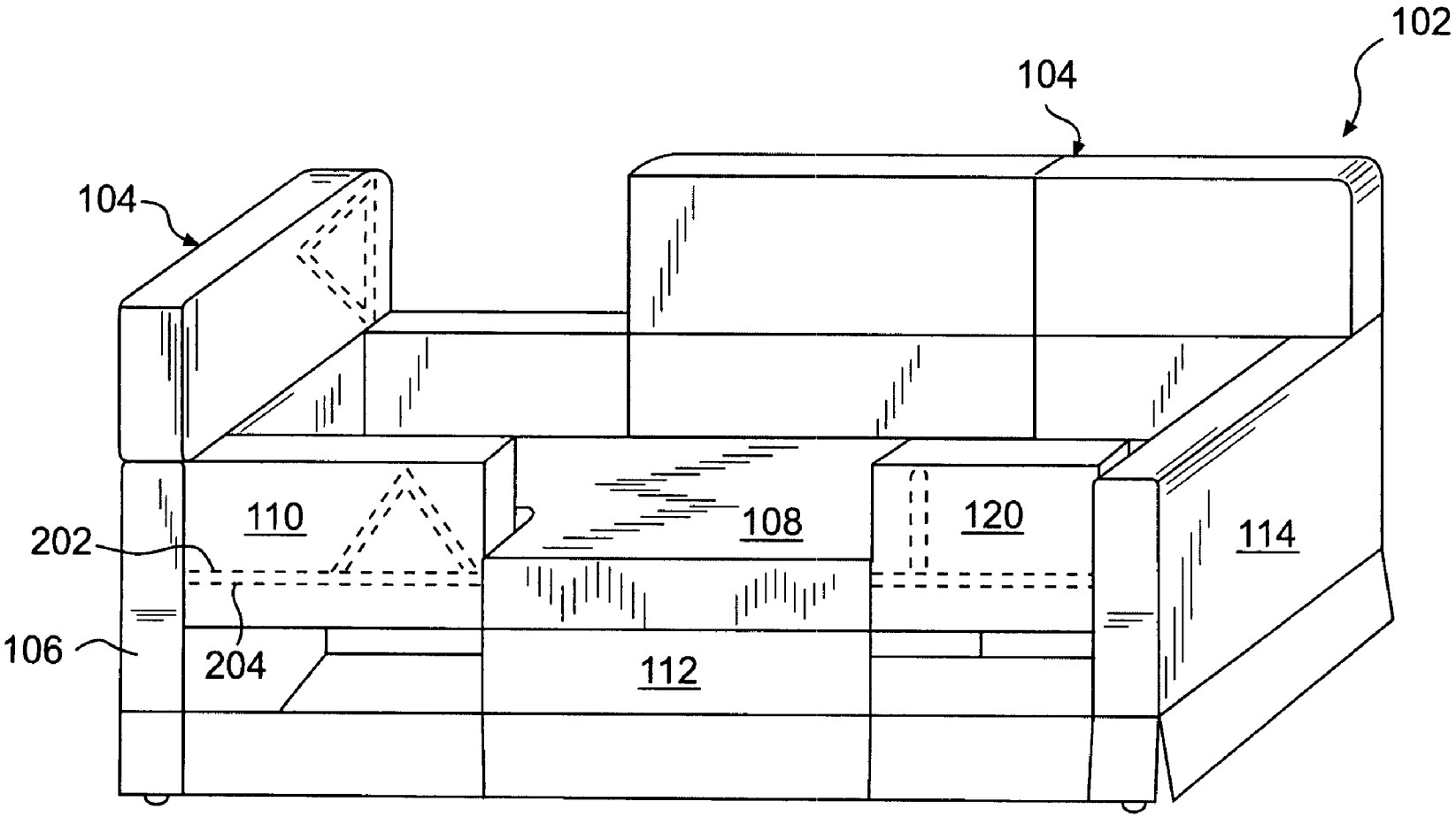
FIG. 2 shows an embodiment of the sofa lover's sofa in a partial lounge configuration.

An embodiment of the present inventive sofa 102 is generally depicted in FIGS. 1 and 2 of the accompanying drawings and includes at least on rotatable backrest 104, at least one standard armrest 106, a seat cushion 108, a rotatable front panel 110, and a center portion 112. Optionally, a second standard armrest 114 can be positioned on a side 116 opposite a side 118 corresponding to the first standard armrest 106. Additionally, a second front panel 120 can be positioned on the same side 116 as the second standard armrest 114. For the sake of discussion, one panel is discussed herein; however, a person having ordinary skill in the art will understand that the second front panel 110 can be made and used by applying the principles disclosed herein in an oppositely oriented fashion.

With reference to FIGS. 2, 3, 4A, and 4B, the front panel 110 is connected to the standard armrest 106 by means of a rotatable rod 202. A first end 204 of the rotatbale rod 202 is connected to an armrest socket 206 located in the standard armrest 106 and a second end 208 of the rotatable rod 202 is connected to a center socket 210 located in the sofa's center portion 112. When the sofa 102 is in a sofa configuration as shown in FIG. 1, the front panel 110 is positioned underneath and perpendicular to the seat cushion 108.

Figure 3:
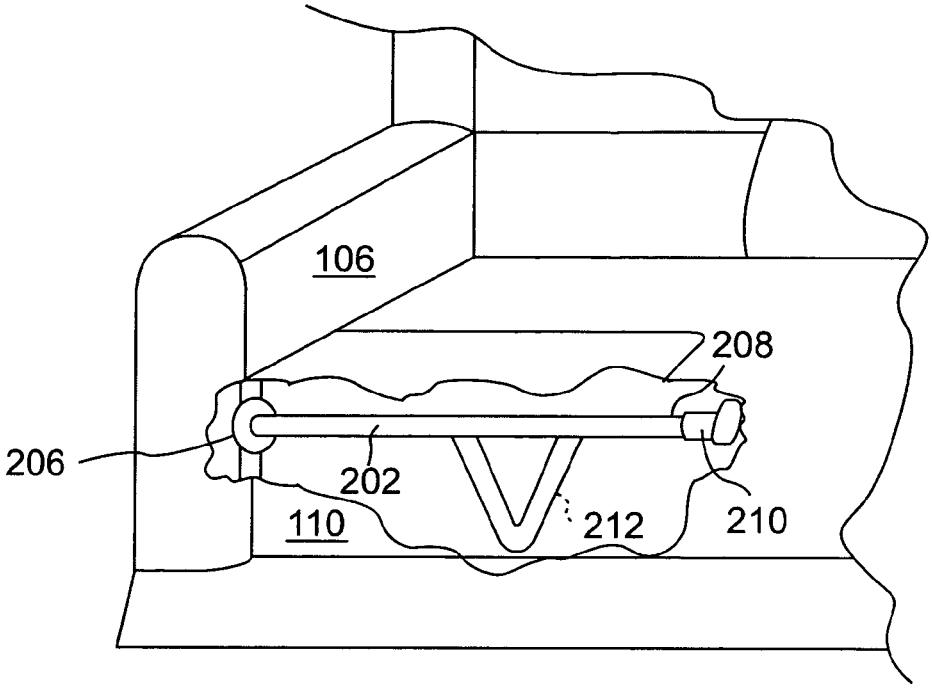
FIG. 3 shows a cutaway view revealing a rotatable rod within a preferred embodiment of the sofa lover's sofa.
Figure 4A:
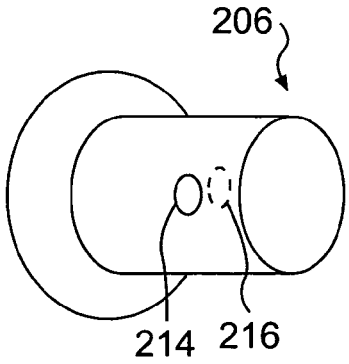
FIG. 4A shows a rotatable rod-receiving socket having a recess within the socket.
Figure 4B:
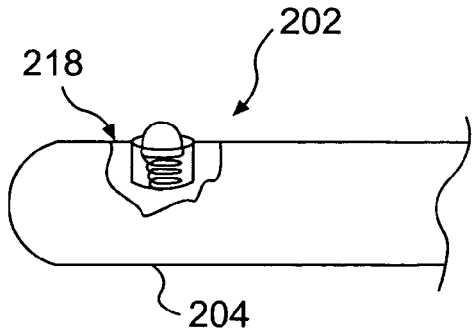
FIG. 4B shows a cutaway view of an armrest segment of the rotatable rod revealing the ball-and-socket configuration.

An extension arm 212 extends from the rotatable rod 202 into the body of the front panel 110 such that, when the rod 202 is rotated, the front panel 110 is rotated along with the rod 202. The extension arm 212 can be in the form of a simple rod or it can be in the form of a plate or other shape that promotes the rotation of the front panel 110, such as triangular or oval. For illustrative purposes, extension arm 212 is shown in FIG. 3 as having a triangular shape.

The armrest socket 206 has two recesses, 214 and 216 beginning on an inner surface thereof, which correspond to a ball-spring assembly 218. The ball-spring assembly 218 can be positioned in the first end 204 of the rotatable rod 202, in the second end 208 of the rotatable rod 202, or in both ends of the rotatable rod 202. The first recess 214 is located in a position such that, when the recess 214 is engaged with the ball-spring assembly 218, the rotatable panel 110 is locked underneath and perpendicular to the seat cushion 108. The second recess 216 is located in a position such that, when the second recess 216 is engaged with the ball-spring assembly 218, the rotatable panel 110 is locked above and perpendicular to the seat cushion 108.

Figure 5:
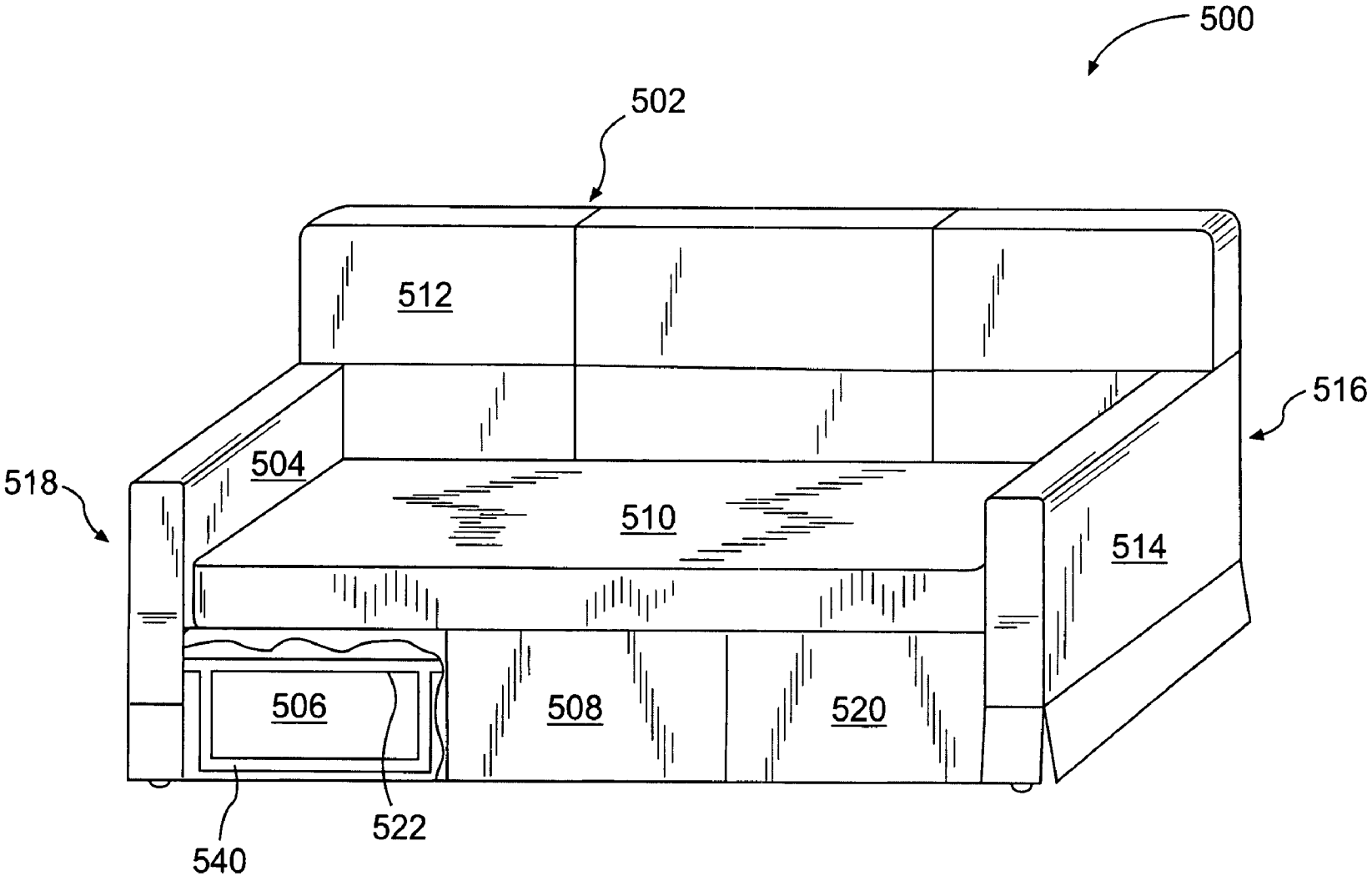
FIG. 5 shows a further embodiment of the sofa lover's sofa in a sofa configuration.
Figure 6:
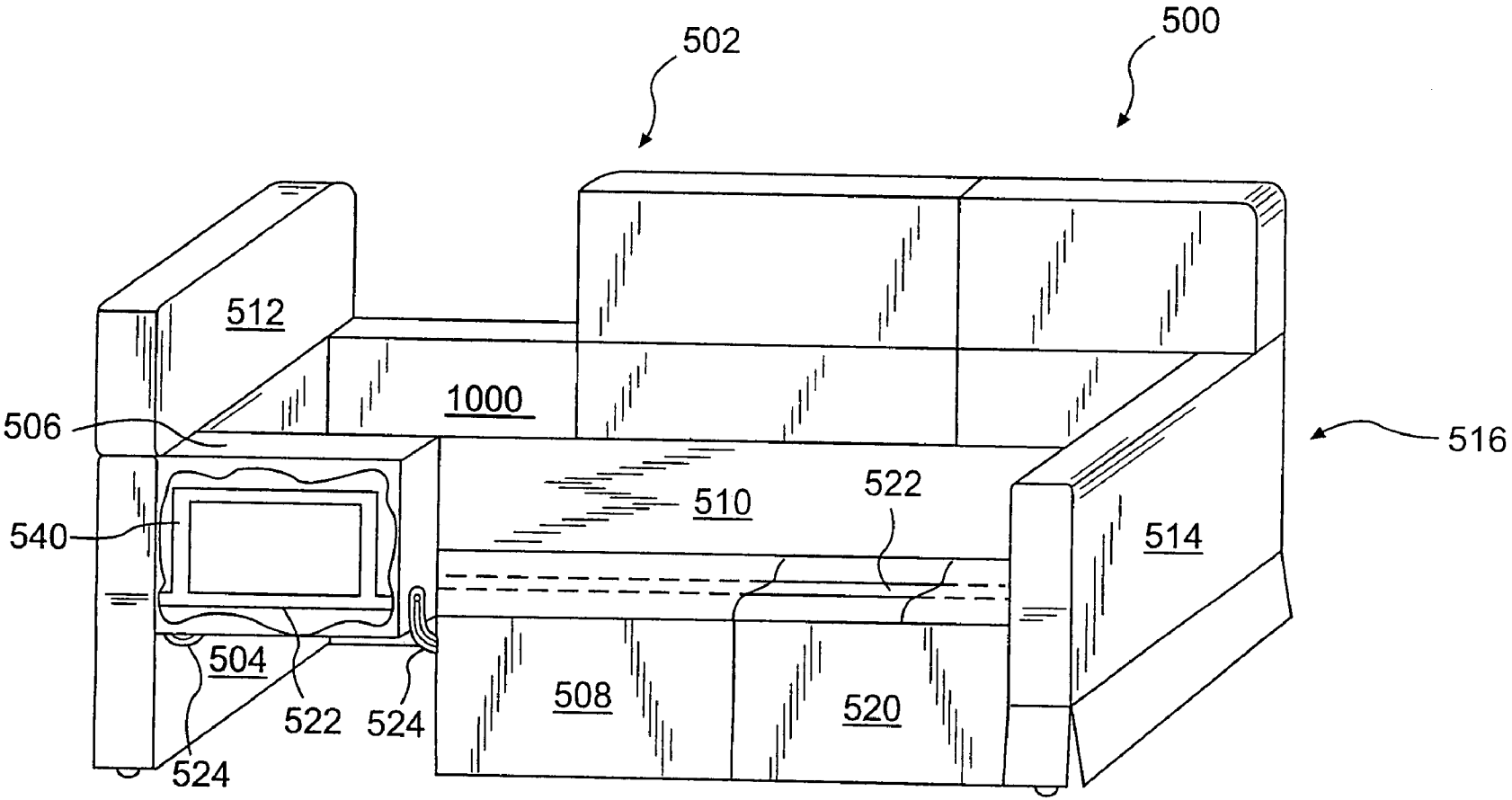
FIG. 6 shows the further embodiment of the sofa lover's sofa in a partial lounge configuration.

With reference to FIGS. 5 and 6, a further embodiment of the sofa lover's sofa 500 can include a center backrest 502, at least one standard armrest 504, a front panel end cushion 506, a front panel center portion 508, a seat cushion 510, a rotatable backrest cushion 512, a non-rotating segment 1000 positioned below the rotatable backrest cushion 512 such that when the end cushion 512 overlies the standard armrest 504, the non-rotating segment 1000 is at a height equal to a height of the standard armrest 504. As with the first embodiment of the inventive sofa, optionally, a second standard armrest 514 can be positioned on a side 516 opposite a side 518 corresponding to the first standard armrest 504. Also, a second panel 520 can be positioned on the same side 516 as the second standard armrest 514. When the sofa 500 is in a sofa configuration as shown in FIG. 5, the front panel end cushion 506 is positioned underneath and perpendicular to the seat cushion 510. For the sake of discussion, one panel cushion is discussed herein; however, a person having ordinary skill in the art will understand that the second panel cushion 506 can be made and used by applying the principles disclosed herein in an oppositely oriented fashion.

The front panel end cushion 506 is connected to the standard armrest 504 by means of a rod 522 that is attached to at least one bracket-and-pin assembly 524. The bracket-and-pin assembly 524 is situated on either or both ends of the front panel end cushion 506. The bracket-and-pin assembly can include two pins (not shown). A first pin is positioned in the standard armrest 504 and a second pin is positioned in the front panel end cushion 506.

Figure 7:
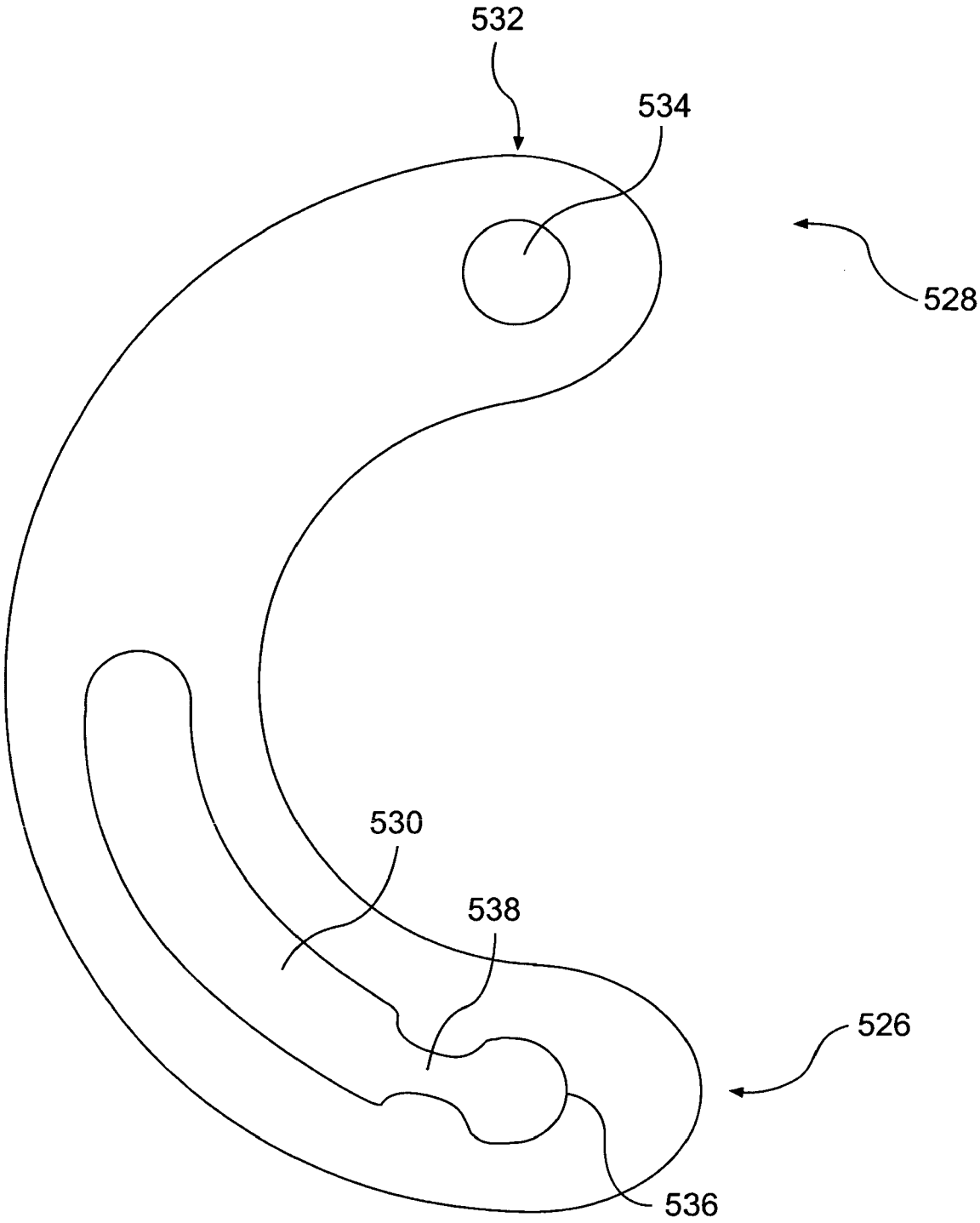
FIG. 7 shows a bracket having a through hole and a slot.

With reference to FIG. 7, a first end 532 of a bracket 528 of the bracket-and-pin assembly 524 can have a hole 534 through which the rod 522 extends. A second end 526 of the bracket 528 can have a slot 530 in which the first (sofa) pin is positioned. In this manner, the front panel end cushion 506 can be placed into an armrest position by causing the front panel end cushion 506 to rotate out away from the sofa 500 such that the bracket 528, which is secured on each end of the front panel end cushions 506 or 520 rotates around the rod 522. And the bracket 528 slides around the sofa pin until the sofa pin is in contact with an end 536 of the slot 530.

Figure 8A:
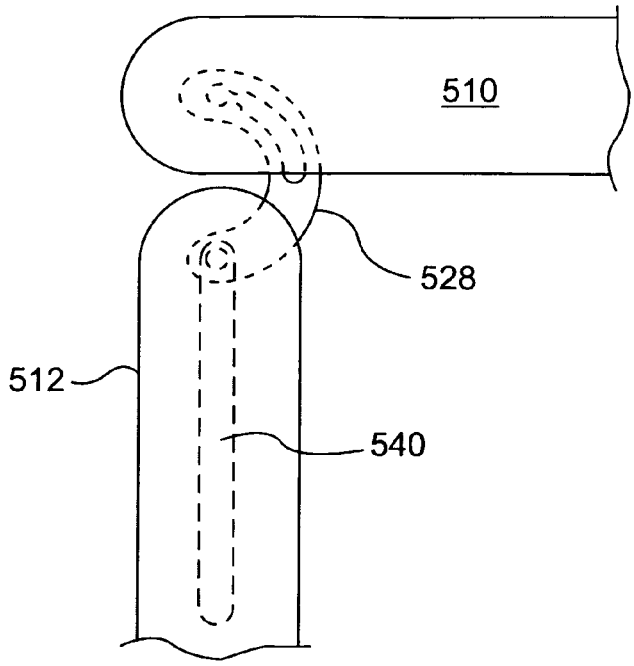
FIGS. 8*a*–8*c* show positions of rotation of a front panel end cushion as it is raised or lowered.
Figure 8B:
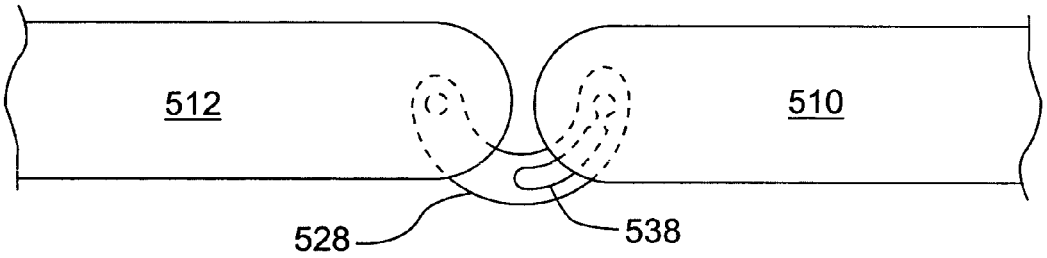
Figure 8C:
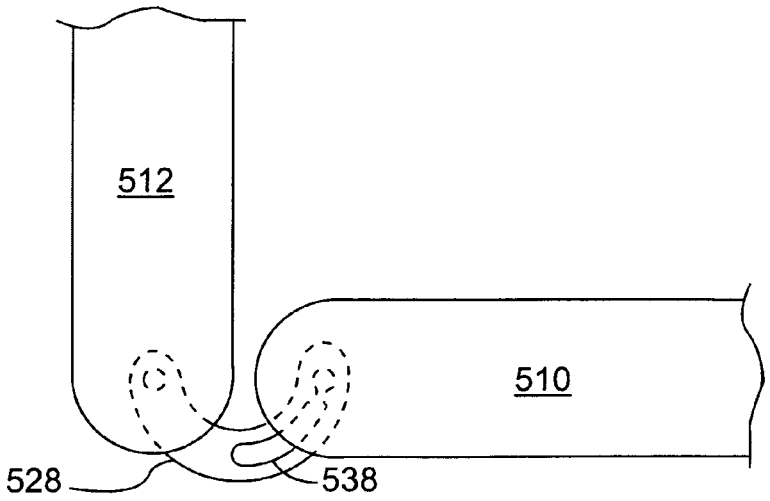

The rod 522, and thus the front panel end cushion, can be held in the armrest position with a slot constriction 538. Once the sofa pin slides past the slot constriction 538 in the bracket 528, the bracket 528 is locked in an armrest position and cannot be replaced into a sofa position without human intervention. The front panel end cushion 506 can then be locked in an upward position using a ball-spring assembly (not shown) as in the first embodiment. In this embodiment, however, the sockets (not shown) for the ball-spring assembly can be located inside the front panel end cushion 506. The positions of rotation of the bracket 528 and the front panel end cushion 506 are shown in FIGS. 8A–8C.

An extension arm 540 extends from the rod 522 into the front panel 506 such that, when the rod 522 is rotated, the front panel 506 is rotated along with the rod 522. The extension arm 540 can act to stiffen the cushion 506 so that, when the front panel end cushion 506 is used as an armrest, it provides firm support for a person's arm. The extension arm 540 can be in the form of a simple rod or it can be in the form of a plate or other shape that promotes the rotation of the front panel 506, such as triangular or oval.

The panel in any of the above embodiments does not have to rotate; it can also slide from a front panel position to an armrest position by the use of a track. The panel can also be moved from a lower panel to position to an armrest position by using a four-bar linkage. Such a linkage is known to a person having ordinary skill in the art to maintain the orientation of the cushion throughout the cushions movement in a standard position, i.e., the orientation of the cushion at any position is parallel to the orientation of the cushion at any other position. A person having ordinary skill in the art will also understand that movement of the cushion in any of the above embodiments can be motorized and powered either by direct- or alternating-current.

A person having ordinary skill in the art will further understand that variations on the sofa lover's sofa are possible. For example, the above inventive disclosure can be applied to chairs, benches, and armless sofas. In the case of a bench, several lower panels can be raised to serve as an arm, a back or to form a crib. In the case of an armless sofa, a side lower panel can be raised to provide arms. And, in the case of a chair, a backrest can be lowered to form an ottoman or vice-versa.

Once given the above disclosure, many other features, modifications and improvements will become apparent to the skilled artisan. For example, the disclosure provided in co-pending application Ser. No. 09/758,660 ("the '660 application) describes many of the features of a rod in a vertical manner. All of the features described as vertical in the '660 application can likewise be applied in a horizontal configuration in the present disclosure. Such features, modifications and improvements are, therefore, considered to be a part of this invention, the scope of which is to be determined by the following claims.

I claim:

1. A sofa usable as a lounge chair comprising:
a backrest;
a lateral seat cushion;
an armrest located next to at least one lateral side of the lateral seat cushion;
a front lower panel having a rotatable panel portion, at least one panel armrest portion and a panel center portion wherein the front lower panel is rotatable; and
a rod extending from the armrest through the rotatable panel portion extending into the panel center portion and having a secondary member extending at an angle perpendicular to an axis of the rod of the rotatable portion.

2. The sofa as recited in claim 1 wherein said front panel is a multi-cushion panel having two end backrest cushions that are rotatable to positions overlying the armrest.

3. The sofa as recited in claim 2 wherein when the two end cushions overlie the armrest, a non-rotating segment of the two end cushions are at a height equal to a height of the sofa armrest.

4. The sofa as recited in claim 3 having a back cushion portion that is rotatable to a position overlying the armrest.

5. A sofa as recited in claim 1, further comprised of a means for supporting said rod for rotation.

6. A sofa as recited in claim 5, further comprised of a means for locking said front lower panel in a fixed position.

7. The sofa as recited in claim 6 wherein the means for locking said rotatable portion in a fixed position is a ball-and-socket mechanism located on an armrest segment of the rod.

* * * * *

UNITED STATES PATENT AND TRADEMARK OFFICE

CERTIFICATE OF CORRECTION

PATENT NO. : 7,134,727 B2
APPLICATION NO. : 10/942910
DATED : November 14, 2006
INVENTOR(S) : Williams It is certified that error appears in the above-identified patent and that said Letters Patent is hereby corrected as shown below:

Claim 1, Column 4, Line 50, Please delete

" cushion; " and replace with

-- cushion located anterior to and at a base of said backrest; --

Claim 1, Column 4, Line 51, Please delete

" of the " and replace with

-- of said --

Claim 1, Column 4, Lines 53-60, Please delete

" a front lower panel having a rotatable panel portion, at least one panel armrest portion and a panel center portion wherein the front lower panel is rotatable; and a rod extending from the armrest through the rotatable panel portion extending into the panel center portion and having a secondary member extending at an angle perpendicular to an axis of the rod of the rotatable poriton."

and replace with

UNITED STATES PATENT AND TRADEMARK OFFICE

CERTIFICATE OF CORRECTION

PATENT NO. : 7,134,727 B2
APPLICATION NO. : 10/942910
DATED : November 14, 2006
INVENTOR(S) : Williams It is certified that error appears in the above-identified patent and that said Letters Patent is hereby corrected as shown below:

Claim 1, Column 4, Lines 53-60, (cont'd)

-- a first front lower panel connected to said armrest, said first front lower panel rotatable from a first position extending vertically below said lateral seat cushion to a second intermediate position and to a third vertical armrest position; a second front lower panel located next to said first front lower panel; and a rod extending from said armrest through said first front lower panel extending into said second front lower panel center portion and having a stiffening member extending from said rod. --

Signed and Sealed this

Sixth Day of March, 2007

JON W. DUDAS
*Director of the United States Patent and Trademark Office*